US010541095B2

(12) United States Patent
Woods et al.

(10) Patent No.: US 10,541,095 B2
(45) Date of Patent: Jan. 21, 2020

(54) FOUR-CONTACT MAGNETIC SWITCH APPARATUS

(71) Applicant: Magnasphere Corporation, Waukesha, WI (US)

(72) Inventors: Christopher Woods, Lee's Summit, MO (US); Randall Woods, Sun Lakes, AZ (US); Joseph C. Hedeen, Menomonee, WI (US)

(73) Assignee: Magnasphere Corporation, Waukesha, WI (US)

( * ) Notice: Subject to any disclaimer, the term of this patent is extended or adjusted under 35 U.S.C. 154(b) by 79 days.

(21) Appl. No.: 15/984,662

(22) Filed: May 21, 2018

(65) Prior Publication Data

US 2018/0337013 A1 Nov. 22, 2018

Related U.S. Application Data

(60) Provisional application No. 62/603,216, filed on May 22, 2017.

(51) Int. Cl.

| | |
|---|---|
| ***H01H 1/16*** | (2006.01) |
| ***H01H 36/00*** | (2006.01) |
| ***G08B 13/08*** | (2006.01) |

(52) U.S. Cl.

CPC ..... *H01H 36/00* (2013.01); *G08B 13/08* (2013.01); *H01H 1/16* (2013.01); *H01H 2036/0086* (2013.01); *H01H 2205/016* (2013.01); *H01H 2225/008* (2013.01); *H01H 2239/032* (2013.01)

(58) Field of Classification Search

CPC .... H01H 1/16; H01H 1/20–2001/2091; H01H 29/20–29/24; H01H 36/00; H01H 2036/0086

USPC ..... 200/61.45 M

See application file for complete search history.

(56) References Cited

U.S. PATENT DOCUMENTS

| | | | |
|---|---|---|---|
| 5,332,992 | A | 7/1994 | Woods |
| 5,530,428 | A | 6/1996 | Woods |
| 5,673,021 | A | 9/1997 | Woods |
| 5,880,659 | A | 3/1999 | Woods |
| 5,977,873 | A | 12/1999 | Woods |
| 6,087,936 | A | 7/2000 | Woods |
| 6,506,987 | B1 | 7/2003 | Woods |
| 6,603,378 | B1 | 8/2003 | Collins |
| 6,803,845 | B2 | 10/2004 | Woods |
| 7,023,308 | B2 | 4/2006 | Woods |
| RE39,731 | E | 7/2007 | Woods |
| 7,291,794 | B2 | 11/2007 | Woods |
| 7,825,801 | B2 | 11/2010 | Woods |
| 7,944,334 | B2 | 5/2011 | Woods |
| 8,228,191 | B2 | 7/2012 | Woods |

(Continued)

*Primary Examiner* — Ramon M Barrera
(74) *Attorney, Agent, or Firm* — Hovey Williams LLP

(57) ABSTRACT

Switch apparatus (54), designed to detect relative movement between first and second members (60, 62), includes a switch assembly (48) comprising a switch unit (20), a biasing element (50), and an operating member (52). The unit (20) has a conductive housing (22) with first, second, and third electrical pin contacts (36-40) and a shiftable body (46). The body (46) is magnetically correlated with both the element (50) and operating member (52). When the members (60, 62) are close, the operating member (52) maintains the shiftable body (46) in one switch position, whereas when the members (60, 62) are separated, the biasing element (50) magnetically moves body (46) to another switch position, thereby detecting the relative movement).

31 Claims, 2 Drawing Sheets

(56) References Cited

U.S. PATENT DOCUMENTS

| | | | |
|---|---|---|---|
| 8,314,698 | B2 | 11/2012 | Woods |
| 8,487,727 | B2 | 7/2013 | Woods et al. |
| 8,648,720 | B2 | 2/2014 | Woods |
| 9,685,289 | B1 | 6/2017 | Woods |
| 9,685,290 | B1 | 6/2017 | Hedeen |
| 9,704,680 | B1 | 7/2017 | Hedeen et al. |
| 9,934,921 | B2 | 4/2018 | Hedeen et al. |

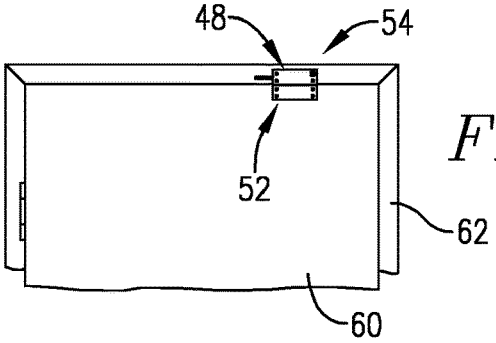
FIG. 4.
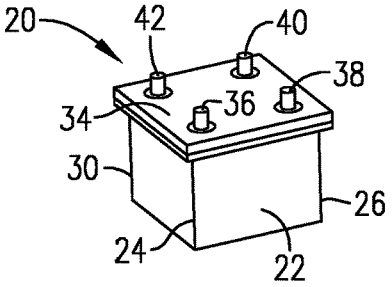
FIG. 1.
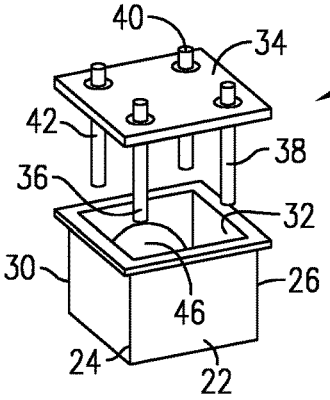
FIG. 2.
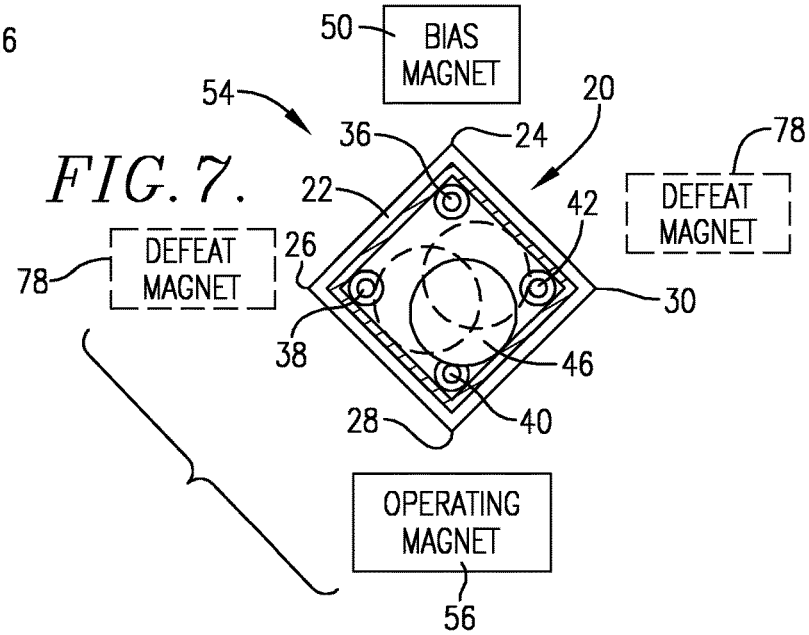
FIG. 7.
FIG. 3.
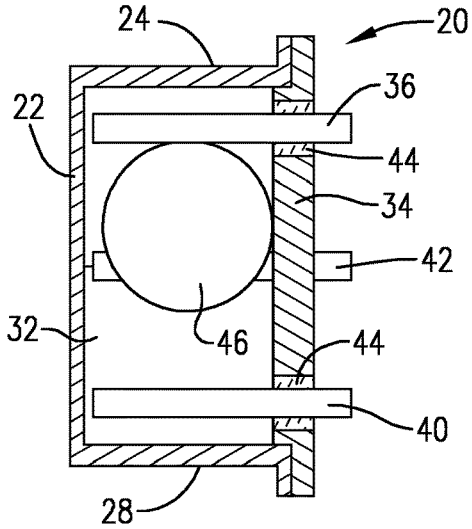
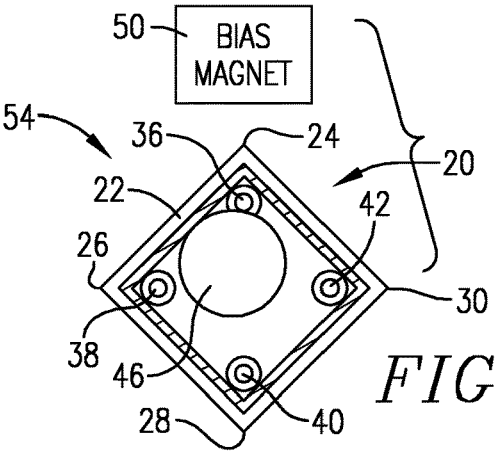
FIG. 8.

FOUR-CONTACT MAGNETIC SWITCH APPARATUS

CROSS-REFERENCE TO RELATED APPLICATION

This application claims the benefit of U.S. provisional patent application Ser. No. 62/603,216 filed May 22, 2017, entitled HIGH SECURITY SWITCH, which is incorporated herein by reference in its entirety.

BACKGROUND OF THE INVENTION

Field of the Invention

The present invention is directed to improvements in magnetic ball switches. More particularly, the invention is concerned with improved switch units, switch assemblies including the units, and complete switch apparatus made up of the switch assemblies together with operating members. The switch technology of the invention provides low cost, high reliability switches, which can be used to good effect in high security protective devices.

Description of the Prior Art

Prior art alarm systems use magnetic switches attached to doors and/or windows for detecting unauthorized opening thereof. One common type of switch used in these systems is a so-called reed switch. Reed switches are subject to unauthorized manipulation through the use of a strong external defeat magnet. That is, an intruder can place a strong magnet in proximity to the reed switch to hold it closed (or opened depending upon the control scheme), and thereby upon a supposedly protected door or window without triggering the alarm system.

Magnasphere Corporation of Waukesha, Wis. commercializes magnet switches giving improved performance and protection against external magnet manipulation. Such switches generally comprise a magnetic housing with an internal switch ball shiftable between a first position in contact with a pair of switch electrodes, and a second position out of such simultaneous contact. Magnetic ball switches are described in U.S. Pat. Nos. 5,332,992, 5,530,428, 5,673,021, 5,880,659, 5,977,873, 6,087,936, 6,506,987, 6,603,378, 6,803,845, 7,023,308, RE39,731, 7,291,794, 7,825,801, 7,944,334, 8,228,191, 8,314,698, 8,487,726, 8,648,720, 9,685,289, 9,685,290, 9,704,680, and 9,934,921.

In certain high security applications, specialized switches are provided which are made up of a pair of magnetic ball switches. While these are highly effective, they do require the use of plural switches and operating components, which must be separately tuned during manufacture of the high security devices. This represents added cost and complexity to the manufacturing process.

SUMMARY OF THE INVENTION

The present invention provides high-integrity switch units, switch assemblies including the units, and complete switch apparatus including the assemblies. By virtue of the construction of these devices, high security switches may be manufactured using only a single magnetic ball switch, thus lowering manufacturing costs.

Thus, the invention provides switch units each comprising a housing having walls presenting electrically conductive zones and a cavity. First and second, spaced part, electrically conductive contacts are within the housing and respectively adjacent corresponding first and second electrically conductive housing wall zones, with the first and second contacts lying on a common axis. A third electrically conductive contact within the housing is located between the first and second contacts and spaced (typically laterally spaced) from the common axis. A shiftable, electrically conductive body is provided within the housing cavity and is magnetically movable between a first switch state where the body is in simultaneous contact with the first contact and a first housing wall zone, a second switch state wherein the body is in contact with the second contact and a second housing wall zone, and a third switch state wherein the body is in contact with the third contact and a third housing wall zone. Each of the first, second, and third contacts are adapted for connection with a controller, such as an alarm controller. If desired, a fourth electrically conductive contact is provided within the housing, located between the first and second contacts and spaced from the common axis so that the third and fourth contacts are on opposite sides of the common axis. In this event, the body is magnetically shiftable to a fourth switch state wherein the body is in contact with the fourth contact and a fourth housing wall zone.

In certain embodiments, the switch unit housing is metallic and is substantially quadrate in plan configuration, and presenting four apices. The first, second, and third contacts, and fourth, if present, are respectively adjacent corresponding apices of the housing. The movable body may in in the form of a spherical magnet or be formed of a ferromagnetic material.

The switch assemblies of the invention each have a switch unit and further include a biasing element proximal to the switch unit housing. The biasing element and the movable body within the switch unit housing are magnetically correlated such that the biasing element magnetically urges the body towards one of the switch states of the unit. However, the body may also be magnetically shifted under the influence of another magnetic field acted upon the body against the magnetic correlation between the body and the biasing means, in order to move the body to another switch position.

The complete magnetic switch apparatus of the invention is especially designed for detecting relative movement between first and second members from a close position wherein the members are proximal, and an open position wherein the members are separated, such as doors or windows. The switch apparatus comprises, in addition to a switch assembly, an operating member, which is magnetically coupled with the shiftable switch unit body such that when the first and second members are in the open position, the operating member magnetically maintains the body in the other of the switch states against the magnetic correlation between the body and the biasing means.

BRIEF DESCRIPTION OF THE DRAWINGS

FIG. 1 is a perspective view of a switch unit in accordance with the invention;

FIG. 2 is a perspective exploded view of the switch unit;

FIG. 3 is an enlarged, vertical sectional view of the switch unit;

FIG. 4 is a fragmentary view of a door and door frame with a magnetic switch apparatus in accordance with the invention shown secured to a door and door frame;

FIG. 7 is a vertical sectional view illustrating the operation of a switch assembly of the invention, during normal use thereof and in the event that an external magnet is employed in an effort to defeat the switch assembly;

FIG. 8 is a view similar to that of FIG. 6, but illustrating the operation of the switch assembly under the influence of a bias magnet forming a part of the assembly;

While the drawings do not necessarily provide exact dimensions or tolerances for the illustrated components or structures, FIGS. 1-3, 5, and 9-10 are to scale with respect to the relationships between the components of the structures illustrated therein.

DETAILED DESCRIPTION OF THE PREFERRED EMBODIMENT

Embodiment of FIGS. 1-8

Figure 9:
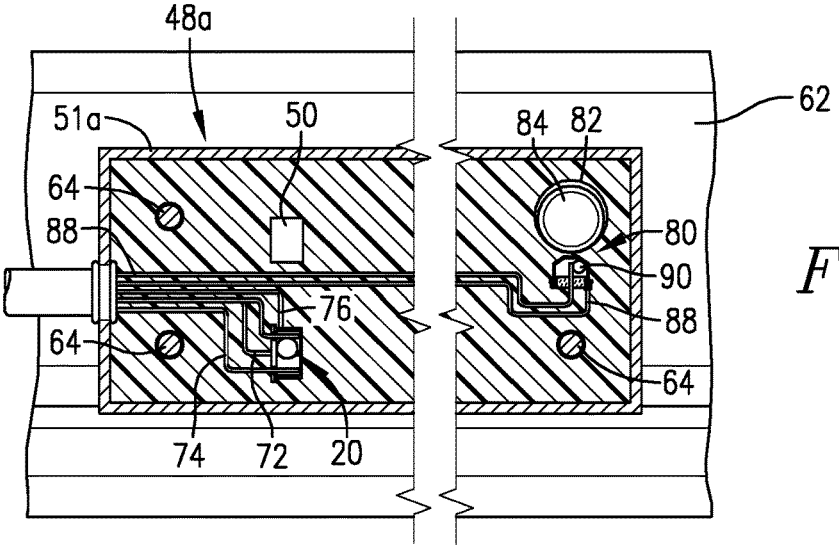
FIG. 9 is a vertical sectional view of a switch assembly including the switch unit of the invention, supplemented with an anti-tamper magnetic switch.

Turning now to the drawings, and particularly FIGS. 1-3 and 5-6, a switch unit 20 is illustrated and broadly includes a quadrate, integral metallic (e.g., a Cu—Ni alloy), electrically conductive housing 22 presenting four apices 24, 26, 28, 30, and an internal cavity 32; as illustrated, the housing 22 includes a base wall and upstanding sidewall structure. The unit further has a cover 34 formed of a low-magnetic susceptibility material such as stainless steel. The cover 34 is equipped with four elongated, electrically conductive contact pins 36, 38, 40, 42, such that when the cover 34 is installed on the open end of housing 22, the pins 36-42 are respectively located in proximity to the apices 24-30 (see FIGS. 7-8). As further illustrated, each pin is secured to the cover 34 by means of adhesive or ceramic material 44, and extends through the cover 34 to permit electrical connection thereof, as will be described. The switch unit also has a shiftable, electrically conductive body 46, here in the form of a chromium-steel spherical ferromagnetic ball coated with a noble metal (e.g., Co—Au alloy).

The switch unit 20 is designed to operate by the assumption of multiple, different switch states, depending upon the magnetic conditions experienced by body 46. One such switch state occurs when the body 46 is in simultaneous contact with pin 36 and the adjacent zone of housing 22 near apex 24 (see FIG. 8). Other switch states occur when the body 46 simultaneously contacts pin 40 and the adjacent zone of housing 22 near apex 28; when the body 46 contacts pin 38 and the adjacent zone of housing 22 near apex 26; and when the body 46 contacts pin 42 and the adjacent zone of housing 22 near apex 30.

Figure 5:
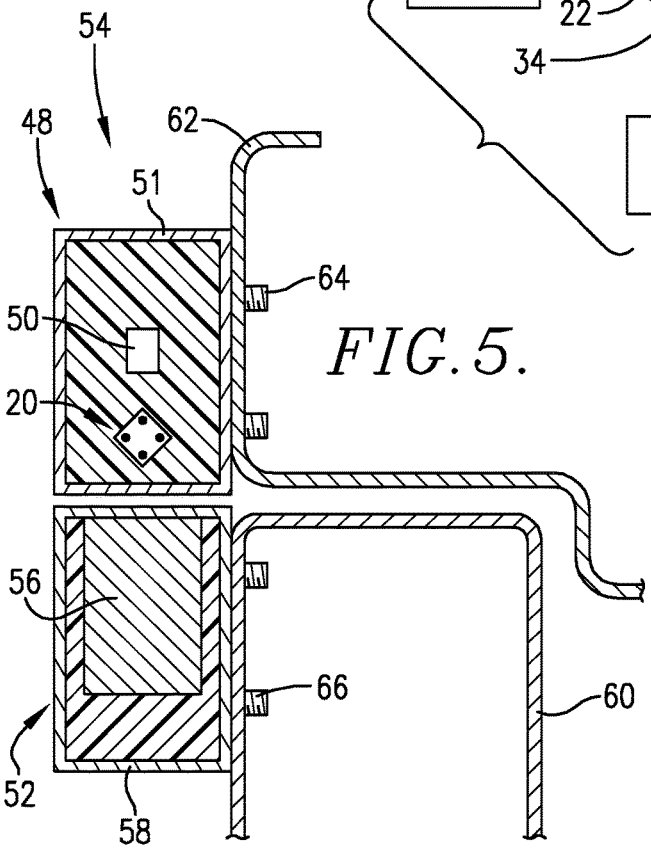
FIG. 5 is a vertical sectional view of the switch apparatus mounted on the door frame and door frame illustrated in FIG. 4.

The switch unit 20 forms a part of a switch assembly 48 including a bias element 50, which is designed to magnetically couple with the body 46. The element 50 may be formed of permanent magnetic material and is placed adjacent the housing 22 in a strategic location so as to bias the body 46 to a desired switch state. This arrangement is illustrated in FIGS. 5, and 7-8 where the element 50 is proximal to apex 24 of housing 22, and both the element 50 and unit 20 are housed within enclosure 51; to this end, the element 50 and unit 20 are embedded within epoxy, and both are carried within a synthetic resin (e.g., ABS) insert which slides into enclosure 51. As can be appreciated, the switch unit 20, in the absence of any other magnetic conditions acted on body 46, will remain in the desired switch state.

Normally, the switch assembly 48 is used with an operating member 52, which also magnetically couples with body 46, forming an overall switch apparatus 54. The operating member 52 is in the form of a permanent magnet component 56, which is housed within an enclosure 58. The complete apparatus 54 is particularly used for detecting relative movement between first and second members, from a close position where the members are proximal, and an open position where the members are separated. For example, the apparatus 54 may be used with a door 60 hingedly mounted with a door frame 62. Alternately, the apparatus 54 could be used to detect relative motion of a window relative to a window frame. In the illustrated embodiment of apparatus 54, the switch assembly 48 is mounted on door frame 62 by means of threaded couplers 64, whereas the operating member 52 is secured to door 60 by similar couplers 66.

Figure 6:
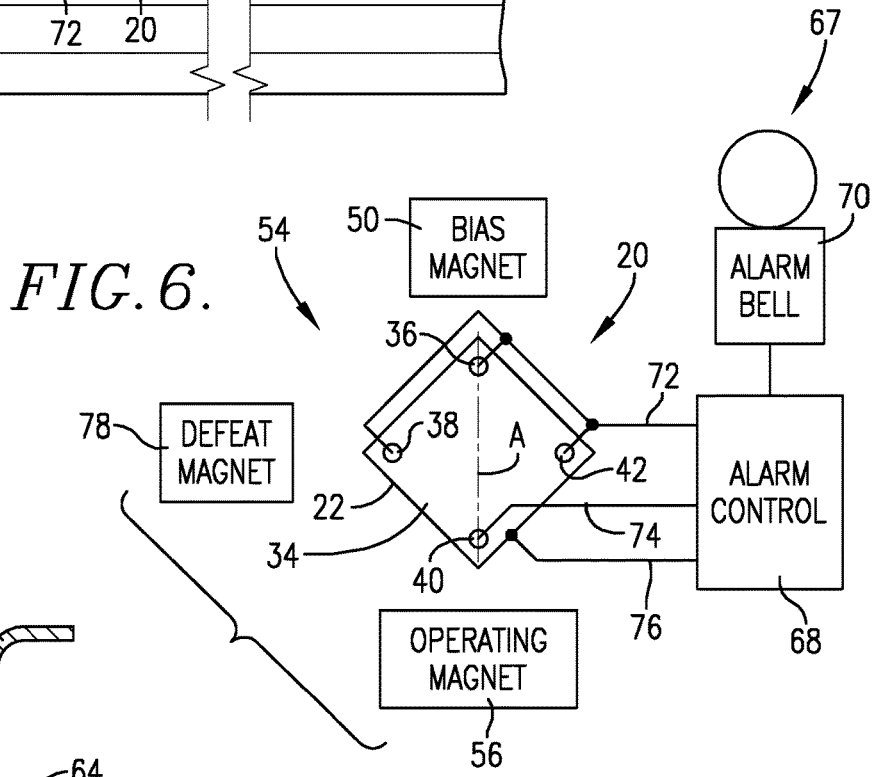
FIG. 6 is a schematic view illustrating a representative electrical connection of the switch unit of FIGS. 1-3 to an alarm assembly.

The switch apparatus 54 is normally connected with an alarm system 67 made up of an alarm controller 68 and an alarm indicator such as a bell 70. An exemplary electrical connection between the switch unit 20 and alarm controller 68 is schematically illustrated in FIG. 6, where it will be seen that the pins 36, 38, and 42 are each connected via a lead 72 to the controller 68, whereas the pin 40 is connected through a separate lead 74. A separate, common ground lead 76 extends from metallic housing 22 to the controller 68.

Operation

A typical operation of magnetic switch apparatus 54 will be described, in the context of protecting against unauthorized opening of door 60. As depicted in this example, the switch unit housing 22 is oriented so that the apex 24 is at the 12 o'clock position, and the apices 26-30 are respectively at the 9 o'clock, 6 o'clock, and 3 o'clock positions. When the door 60 is closed and the alarm system 67 is armed to detect an unauthorized opening, the operating magnet 56 is directly below the switch unit 20 (FIG. 5). In this orientation, the component 56 is magnetically coupled with the body 46 and serve to magnetically move the body to the 6 o'clock position shown in full lines in FIG. 7, where the body 46 simultaneously engages pin 40 and housing 22 adjacent apex 28. This can be deemed a first switch position for the apparatus 54.

If the door 60 is forcibly opened, the component 56 is shifted out of proximity to the switch unit 20. When this occurs, the magnetic coupling between bias element 50 and body 46 comes into play, in order to shift the body 46 upwardly to the 12 o'clock position, as viewed in FIG. 8, so that the body 46 simultaneously contacts pin 36 and the adjacent zone of housing 22 proximal to apex 24. Thus, the switch unit 20 assumes a second switch position.

It sometimes occurs that alarm assemblies are defeated by placing a strong "defeat" magnet 78 adjacent the switch unit 20, for example directly against the enclosure 51. The present invention precludes this effect, as best depicted in phantom in FIG. 7. That is, a defeat magnet 78 placed close to apex 26 of housing 22 will move the body 46 to a 9 o'clock third switch position, and a corresponding third switch state, wherein the body is in simultaneous contact with pin 38 and the adjacent zone of housing 22 near apex 26. Also, in the illustrated embodiment, if the defeat magnet 78 is placed in an opposite orientation close to apex 30, the body 46 is magnetically shifted to a 3 o'clock fourth switch position and state in contact with the pin 42 and the adjacent zone of the housing 22. It will be appreciated that, owing to the electrical connection between switch unit 20 and alarm controller 68, the second, third, and fourth switch positions and states are all considered as alarm conditions, causing actuation of the bell 70.

Figure 10:
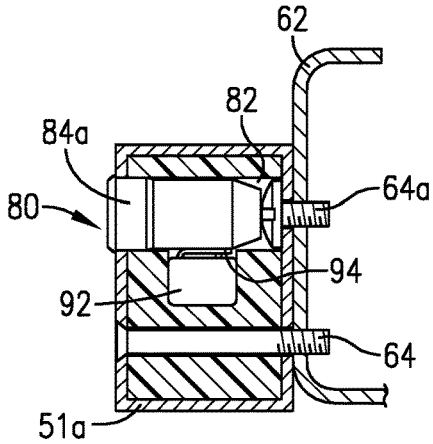
FIG. 10 is a vertical sectional view of a switch assembly including the switch unit of the invention, supplemented with an anti-tamper microswitch.

Embodiment of FIGS. 9-10

It sometimes occurs that an attempt is made to defeat an alarm assembly by detaching parts of the alarm from the protected members. For example, an effort may be made to detach the alarm assembly 48 from door frame 62 by removing the threaded connectors 64. In order to prevent this type of defeat, a switch assembly 48*a* may be employed. The assembly 48*a* includes all of the components of assembly 48, namely switch unit 20, bias element 50, and connection leads 72-76, within an enclosure 51*a* similar to previously described enclosure 51, with enclosure 51*a* secured to door frame 62 by couplers 64. However, the assembly 48*a* further has anti-tamper mechanism 80 designed to detect the removal of the couplers 64, and to sound a corresponding alarm.

In detail, it will be seen that one of the couplers 64*a* is in the form of a short screw within an enlarged cavity 82 of enclosure 51*a*. A plug 84 is situated within the cavity 82 and must be removed from the cavity in order to allow access to the coupler 64*a*. In the embodiment of FIG. 9, the plug 84 is formed of a ferromagnetic material, the mechanism 80 includes a magnetic ball switch 86, commercialized by Magnasphere Corporation of Waukesha, Wis., electrically connected with alarm controller 68 via electrical leads 88. The switch 86 is of the type described in U.S. Pat. Nos. 8,228,191 and 7,944,334, incorporated by reference herein in their entireties. The switch 86 includes a metallic, can-like, closed housing with a central conductive electrode extending into the housing. A shiftable magnetic or ferromagnetic ball within the housing moves between first and second switch positions depending upon the magnetic conditions acted upon the ball.

The magnet ball switch 86 is maintained in a first switch state by virtue of the magnetic coupling between the plug 84 and the switch ball. When the plug 84 is removed, the magnetic condition acted upon the ball are changed, and the ball moves to a second, alarm switch condition. Hence, if an attempt is made to remove the enclosure 51*a*, the mechanism 80 comes into play to initiate the alarm.

A similar embodiment is depicted in FIG. 10, wherein a plug 84*a* is employed, which need not be ferromagnetic. To this end, the mechanism 80 includes a microswitch 92 having a pivotal arm operator 94. When the plug 84*a* is removed from the cavity 80, the switch arm 94 pivots open, thereby initiating the intrusion alarm.

The foregoing discussion illustrates a particular embodiment of the invention making use of a quadrate metallic housing 22 oriented in an essentially upright position. It should be understood, however, that the invention is not limited to these details. For example, the housing need not be fully metallic, but need only have electrically conductive contact zones proximal to the individual pin contacts 36-42. Moreover, the housing need not be fully upright as depicted, and may assume a variety of different orientations. In general, however, the housing is plus or minus 30 degrees from true vertical (FIG. 6). In such situations, the first and second switch positions and states may be deemed to be at 6 and 12 o'clock, so that the corresponding pin contacts lie on the common vertical axis A shown in FIG. 8. Therefore, the third and fourth switch positions and states are at 3 and 9 o'clock, or between the first and second switch positions and states and on opposite sides of the common axis. Still further, the housing 22 need not be quadrate in configuration, but can be circular, oval, or any other convenient shape, provided that the switch unit can assume respective different switch states. Finally, so long as the ball 46, element 50, and member 52 are magnetically coupled, the material making up these components can be selected from a variety of candidate materials, be they ferromagnetic or permanently magnetic as the case may be.

It will also be appreciated that the switch units 20, and the corresponding switch assemblies 48, can be used in a variety of contexts apart from detecting relative movement between first and second members. For example, the units 20 could be used in the high security switch assemblies of U.S. Pat. No. 8,487,726 (incorporated by reference herein in its entirety) in lieu of the magnetic ball switches disclosed therein.

We claim:

1. Magnetic switch apparatus for detecting relative movement between first and second members from a close position wherein the members are proximal, and an open position wherein the members are separated, said apparatus comprising:

a switch assembly for mounting on one of said members, including— a switch unit having a housing having walls presenting electrically conductive zones and a cavity;

first and second, spaced apart, electrically conductive contacts within said housing and respectively adjacent corresponding first and second electrically conductive housing wall zones;

a shiftable, electrically conductive body within said housing and magnetically movable between a first switch state where the body is in simultaneous contact with said first contact and a first housing wall zone, and a second switch position wherein the body is in contact with said second contact and a second housing wall zone;

a biasing element proximal to said housing, said biasing element and body being magnetically correlated such that when the first and second members are in said open position, said biasing element magnetically maintains said body in one of said switch states;

an operating member configured for mounting on the other of said members, said operating member and said switch assembly being magnetically correlated such that when said first and second members are in said close position, said operating member magnetically maintains said body in the other of said switch states against the magnetic correlation between said body and said biasing means, said switch unit further including a third electrically conductive contact within the housing, located between said first and second contacts, and adjacent a corresponding third conductive housing wall zone, and said body shiftable within said housing to a third switch state where the body is in simultaneous contact with said third contact and said third conductive housing wall zone, under the influence of an external defeat magnet placed proximal to said housing.

2. The apparatus of claim 1, there being a fourth electrically conductive contact within the zone, located between said first and second contacts, generally opposed to said third contact, and adjacent a corresponding fourth conducting housing wall zone, said body shiftable within said housing to a fourth switch state where the body is in simultaneous contact with said fourth contact and said fourth conductive housing wall zone, under the influence of an external magnet placed proximal to said housing.

3. The apparatus of claim 1, said first and second contacts being spaced apart and lie on a common axis, said third contact in laterally spaced relationship to said common axis.

4. The apparatus of claim 1, there being a first switch circuit including said first and third contacts, and a second switch circuit including said second switch contact.

5. The apparatus of claim 1, said shiftable body being spherical.

6. The apparatus of claim 1, said first, second, and third contacts being elongate and adjacent to the corresponding first, second, and third housing wall zones.

7. The apparatus of claim 1, said one member being a door frame, and the other member being a movable door.

8. The apparatus of claim 1, including an outer switch assembly enclosure having therein said housing and biasing element.

9. The apparatus of claim 1, including an outer enclosure having therein said operating member.

10. The apparatus of claim 1, said shiftable body being of ferromagnetic material, and said biasing element being a permanent magnet.

11. The apparatus of claim 1, said housing including a dielectric cover, said first, second, and third contacts extending through said cover.

12. The apparatus of claim 1, said housing being substantially quadrate in plan configuration and presenting four vertices, the housing being oriented with two of said vertices being substantially vertically spaced apart.

13. The apparatus of claim 12, said first, second, and third contacts each being located proximal to a vertex of said housing.

14. The apparatus of claim 1, said housing walls being metallic and electrically conductive.

15. The apparatus of claim 1, including connector structure for said switch apparatus, and further including a tamper switch operably coupled with said connector structure for causing said body to move to one of said switch states in the event of an attempted tampering with said connector structure.

16. A switch assembly comprising:

a switch unit having— a housing having walls presenting electrically conductive zones;

first and second, spaced apart, electrically conductive contacts within said housing and respectively adjacent corresponding first and second electrically conductive housing wall zones;

a shiftable, electrically conductive body within said housing and magnetically movable between a first switch state where the body is in simultaneous contact with said first contact and a first housing wall zone, and a second switch position wherein the body is in contact with said second contact and a second housing wall zone;

a biasing element proximal to said housing, said biasing element and body being magnetically correlated such that said biasing element magnetically urges said body towards one of said switch states, said body being magnetically shiftable under the influence of a magnetic field acted upon said body against the magnetic correlation between said body and said biasing element, in order to move said body to said second switch position;

a third electrically conductive contact within said housing, located between said first and second contacts, and adjacent a corresponding third conductive housing wall zone, said body shiftable within said housing to a third switch state where said body is in simultaneous contact with said third contact and said third conductive housing wall zone, under the influence of an external defeat magnet placed proximal to said housing.

17. The assembly of claim 16, there being a fourth electrically conductive contact within the zone, located between said first and second contacts, generally opposed to said third contact, and adjacent a corresponding fourth conducting housing wall zone, said body shiftable within said housing to a fourth switch state where the body is in simultaneous contact with said fourth contact and said fourth conductive housing wall zone, under the influence of an external magnet placed proximal to said housing.

18. The assembly of claim 16, said first and second contacts being spaced apart and lie on a common axis, said third contact in laterally spaced relationship to said common axis.

19. The assembly of claim 16, there being a first switch circuit including said first and third contacts, and a second switch circuit including said second switch contact.

20. The assembly of claim 16, said shiftable body being spherical.

21. The assembly of claim 16, said first, second, and third contacts being elongate and adjacent to the corresponding first, second, and third housing wall zones.

22. The assembly of claim 16, said shiftable body being of ferromagnetic material, and said biasing element being a permanent magnet.

23. The assembly of claim 16, said housing including a stainless steel cover, said first, second, and third contacts extending through said cover.

24. The apparatus of claim 16, said housing being substantially quadrate in plan configuration and presenting four vertices, the housing being oriented with two of said vertices being substantially vertically spaced apart.

25. The apparatus of claim 24, said first, second, and third contacts each being located proximal to a vertex of said housing.

26. The apparatus of claim 16, said housing walls being metallic and electrically conductive.

27. The apparatus of claim 16, including connector structure for said switch apparatus, and further including a tamper switch operably coupled with said connector structure for causing said body to move to one of said switch states in the event of an attempted tampering with said connector structure.

28. A switch unit comprising:

a housing having walls presenting electrically conductive zones and a cavity;

first and second, spaced part, electrically conductive contacts within said housing and respectively adjacent corresponding first and second electrically conductive housing wall zones, said first and second contacts lying on a common axis;

a third electrically conductive contact within said housing located between said first and second contacts and spaced from said common axis;

a shiftable, electrically conductive body within said housing cavity and movable between a first switch state where the body is in simultaneous contact with said first contact and a first housing wall zone, a second switch state wherein the body is in contact with said second contact and a second housing wall zone, and a third switch state wherein the body is in contact with said third contact and a third housing wall zone, said first, second, and third contacts being adapted for connection with a controller.

29. The switch unit of claim 28, including a fourth electrically conductive contact within said housing, located between said first and second contacts and spaced from said common axis so that the third and fourth contacts are on opposite sides of the common axis, said body shiftable to a fourth switch state wherein the body is in contact with said fourth contact and a fourth housing wall zone.

30. The switch unit of claim 28, said housing being substantially quadrate in plan configuration and presenting four apices, said first, second, and third contacts respectively adjacent corresponding apices of the housing.

31. The switch unit of claim 28, said body comprising a spherical ferromagnetic body.

* * * * *